US005727889A

United States Patent [19]

Koyabu

[11] Patent Number: 5,727,889

[45] Date of Patent: Mar. 17, 1998

[54] PRINTER HAVING A CUTTER WITH A COVER

[75] Inventor: Akira Koyabu, Nagano, Japan

[73] Assignee: Seiko Epson Corporation, Tokyo, Japan

[21] Appl. No.: 686,483

[22] Filed: Jul. 26, 1996

Related U.S. Application Data

[63] Continuation of Ser. No. 452,102, May 26, 1995, abandoned.

[30] Foreign Application Priority Data

May 27, 1994 [JP] Japan ..... 6-115572

[51] Int. Cl.[6] ..... B41J 11/70

[52] U.S. Cl. ..... 400/621; 400/593

[58] Field of Search ..... 400/621, 593, 400/621.1; 83/397, 397.1, 398

[56] References Cited

U.S. PATENT DOCUMENTS

| | | | |
|---|---|---|---|
| 4,592,669 | 6/1986 | Lohse et al. | 400/621 |
| 4,668,960 | 5/1987 | Okamura | 400/621 |
| 4,907,014 | 3/1990 | Tzeng et al. | 400/621 |
| 4,940,347 | 7/1990 | Lund | 400/621.1 |
| 4,984,916 | 1/1991 | Sekine et al. | 400/621 |
| 5,558,451 | 9/1996 | Hanabusa et al. | 400/637 |

FOREIGN PATENT DOCUMENTS

| | | |
|---|---|---|
| 0113701 | 10/1986 | European Pat. Off. . |
| 0443907 | 8/1991 | European Pat. Off. . |

*Primary Examiner*—John S. Hilten

*Attorney, Agent, or Firm*—Sughrue, Mion, Zinn, Macpeak & Seas, PLLC

[57] ABSTRACT

A printer having a cutter for cutting continuous recording paper to length. A cutter fitting stand is secured onto a writing table and fixedly fitted with a cutter having a blade for cutting recording paper. Projections each having holes for supporting a cutter cover shaft are each provided on both left and right ends of the cutter fitting stand. On both sides of the cutter cover shaft, end portions are provided for restraining the separation of receipt paper and a writing table from each other. Further, a cutter cover always urged by a cover spring in a predetermined direction is rotatably furnished.

19 Claims, 6 Drawing Sheets

PRINTER HAVING A CUTTER WITH A COVER

This is a Continuation of Application Ser. No. 08/452,102 filed May 26, 1995, now abandoned.

FIELD OF THE INVENTION

The present invention relates to a printer equipped with a cutter mechanism for cutting continuous paper at a desired position for use in, for example, ECR.

BACKGROUND OF THE INVENTION

FIG. 7 shows a typical example of the prior art of the sort stated above, and a description will be given of what is based on the prior art. FIG. 7 is a sectional view illustrating such a printer. A wire dot printhead 3 is guided by a guide shaft 12 and a guide shaft 14 arranged in parallel to a printing frame 29 and securely fixed to a moving carriage 13 in a direction perpendicular to the direction in which recording paper is conveyed.

The recording paper, that is, the continuous recording paper, is rewound out of rolled paper 30 and guided through a clearance between a lower paper guide 15 and an upper paper guide 26 before being led to a paper feed drive.

The paper feed drive includes a paper feed roller 17 secured to a driving shaft whose rotation is controlled and a pinch roller 16 pressed against the paper feed roller 17. While being held between the paper feed roller 17 and the pinch roller 16, the recording paper is conveyed in the direction of the cutter 23 via a clearance between the printhead 3 and a platen 10 positioned opposite to the printhead 3.

Recording paper for use in printers for ECRs or POS systems in retail stores includes receipt paper to be cut off and used as receipts after printing operations, and journal paper to be kept in the stores for recording purposes. When only a receipt is issued, one sheet of recording paper is used, whereas when a record is kept on the journal paper in addition to the receipt paper, a plurality of sheets of recording paper including pressure sensitive copying paper are used. In the case where the plurality of sheets of recording paper are employed, the sheet of recording paper on the lowermost side is rolled around a take-up shaft and the other sheets of recording paper are used as a receipt, a slip and the like.

The typical example shown in FIG. 7 utilizes two sheets of recording paper, one of which on the upper side is used as receipt paper, and the other on the lower side as journal paper. The receipt paper 5 is cut off by the cutter 23.

With respect to the journal paper 4, the back surface of the recording paper is conveyed along the flat plate 6a of a writing table 6 before being wound on the take-up shaft 18 placed in a casing so as to allow a memo and a cancellation line to be written on the printed recording paper.

A detailed description will subsequently be given of the cutter 23 as viewed from the printing position of the printhead 3. When such a receipt is issued, the recording paper is conveyed so that the final printing line is located on the downstream side of the blade of the cutter 23 after the desired final printing line is printed, and then stopped before being cut off. In order to shorten the time required for the receipt to be issued after an input is provided by an operator, or in order to decrease the upper blank portion of the receipt, the distance between the printing position and the cutter 23 is often set short.

However, when this is done, there arise the following problems concerning the conventional mechanism described above. In a case where the operator happens to interfere with the movement of the recording paper by grabbing the front end of the receipt paper 5, which will result in stopping it from being conveyed, or otherwise holding it down onto the writing table 6 during the time the printing operation is performed or the recording paper is conveyed, the paper feeding pitch becomes less in quantity than what has been intended because the distance between the printing position and the cutter 23 is so short that the recording paper set between the printing position and the paper discharge port at the cutter position is stiff. Consequently, there has occurred not only poor paper feeding but also overlapped printing which results in inferior printing quality which causes illegible print.

Moreover, the recording paper which is conveyed while adhering to the surface of the platen 10 may float up from the platen or may be caught by the moving printhead 3. As a result, there arise problems in that a mask plate 11 for use in pressing the recording paper against the platen 10 may come out of order or tearing of paper may cause paper jamming. In the case of a printer in which an operator is to cut recording paper by moving it, any problem originating from the performance of the operator still remains unavoidable and tends to become critical.

FIG. 8 shows another example of the prior art, which is intended to solve the problems posed in connection with the first example thereof. In the prior art shown in FIG. 8, the cutting position of a cutter 24 is set far from the printing position, and a casing 22 is configured so that it is inflated outward to provide a space above the printhead 3 and the platen 10. FIGS. 8, 9 illustrate a case where the recording paper is stopped from being conveyed in the second example of the prior art.

FIG. 9 refers to a case where the operator interferes with the movement of the receipt paper 5. As shown in FIG. 9, the recording paper is less stiff because the printhead 3 is set far apart from the position at which the receipt paper 5 is prevented from being conveyed, and the receipt paper 5 becomes loose within the space situated above the printhead 3. Consequently, a paper feeding pitch in the vicinity of the printhead 3 is made free from being affected even when the operator interferes with the movement of the receipt paper 5. In other words, there exist no problems arising from unsatisfactory paper feeding, overlapped printing, the malfunction of the mask plate and the paper jamming caused by the tearing of paper as in the first example of the prior art.

However, the problem in this case is that the time required to issue such receipt paper tends to become delayed partly because the distance L between the printing position of the printhead 3 and the cutting position of the cutter 24 is long and partly because it takes time to convey the paper so as to let the final printing line go over its cutting position.

Further, the upper blank portion of the next receipt is enlarged and this also poses the problem of increasing a wasteful portion of the recording paper.

Since the writing table 6 is within the casing 22 in the prior art shown in FIGS. 8 and 9, moreover, the operability is poor in that the casing 22 has to be opened each time the operator tries to write something on the journal paper.

More specifically, the first and second examples of the prior art shown in FIGS. 7 and 8 have features and shortcomings contrary to each other in view of the following functions required for the cutter mechanism mounted on the printer: shorter receipt issuing time; the saving of the upper blank of the next receipt; the simplification of the writing operation; and paper jamming originating from the misoperation of the operator.

The edges of the blades common to the prior art shown in FIGS. 7 and 8 are arranged on the opening side of the casing so as to facilitate the cutting operation. Consequently, there still exists another problem in that the operator may touch the edge of the blade, thus hurting in the finger during the operation of cutting off the receipt or the writing operation.

SUMMARY OF THE INVENTION

An object of the present invention is to obviate the foregoing drawbacks. More specifically, an object of the present invention is to provide a printer whose functions and reliability are improved, which is free from paper jamming and which is capable of issuing receipts at high speed.

In order to solve the problems above according to the present invention, a printer having a cutter for cutting continuous recording paper is provided.

A recording paper guide member for forming a recording paper passageway by regulating the back surface of the recording paper printed by the printing unit is placed on the downstream side of a printing unit. Moreover, a cutter is placed opposite to the recording paper guide member in such a manner as to leave a clearance through which the recording paper is passed. The cutter provided with a blade for cutting the recording paper in a direction perpendicular to the direction in which the recording paper is conveyed. A cutter cover is pivotally moved and has a regulating end portion for regulating a space between the recording paper on the downstream side of the cutter and the recording paper guide member. The cutter cover is urged by urging means so that a space between the regulating end portion and the recording paper guide member is narrowed, and wherein the space between the recording paper and the recording paper guide member is made variable in accordance with the position of the recording paper.

In the printer thus constructed, the recording paper is less stiff and its mid-portion becomes loose since the position at which the operator interferes with the movement of the paper is set apart from the printing unit due to the cutter cover. The recording paper thus loosened contacts against the regulating end portion of the cutter cover and is forced upward. However, the loosened region of the recording paper widens as the cutter cover pivots further, whereby the recording paper at the printing position is made free from any interference with its movement. Since the paper feeding pitch in the vicinity of the printing unit remains unaffected thereby, it is possible to solve problems arising from unsatisfactory paper feeding, overlapped printing, the malfunction of the mask plate and the paper jamming caused by the tearing of paper. When the recording paper is cut, moreover, it can be cut by the cutter at a position close to the printing unit as the cutter cover pivots, whereby only a short time is required to convey the recording paper up to the position where the final printing line is cut while the time required to issue a receipt is shortened. Although the recording paper between the upper end of the remaining recording paper and the printing unit is left as a margin, the margin can be decreased with the effect of reducing the quantity of recording paper for use. In a case where it is needed to make an entry into the recording paper, any correction, for example, can also be made by turning the cutter cover to utilize the recording paper guide member. After the termination of the writing operation, the cutter cover is automatically reset to the standby position, and the casing needs not opening or closing, so that the operability is improved.

Since the urging means operates by its own weight, no urging member is additionally needed and this contributes to offering inexpensive products resulting from reduction in size, part and assembly costs.

With the use of a spring as the urging means, design freedom is increased as the intended effect is achievable, irrespective of the shape of the cutter cover and its position.

Further, the recording paper guide member is formed with either a protrusion or an upright part on the downstream side of the protrusion for moving the recording paper closer to the cutter in between the cutter and the end portion of the cutter cover on standby. Consequently, the recording paper is always kept bent by the projection and when its movement is hindered, it is bent from the projection at all times, whereby when its movement is obstructed, the paper feeding pitch in the vicinity of the printing unit can certainly be rendered free from being affected thereby. The reliability of the printer is thus improved further.

BRIEF DESCRIPTION OF THE DRAWINGS

The invention will be disclosed in detail with reference to the following drawings wherein.

DETAILED DESCRIPTION OF THE INVENTION

1st Embodiment

Referring to FIGS. 1 to 4, the first embodiment of the present invention will be described now.

The basic construction of a printer according to the present invention is similar to that of an ordinary serial wire-dot printer. A printhead with wire dots for striking an inked ribbon onto recording paper is mounted on a carriage which reciprocates in a direction perpendicular to the direction in which recording paper is conveyed, so the printhead is movably used for printing characters or image information on the recording paper conveyed in between a platen and the printhead.

Figure 1:
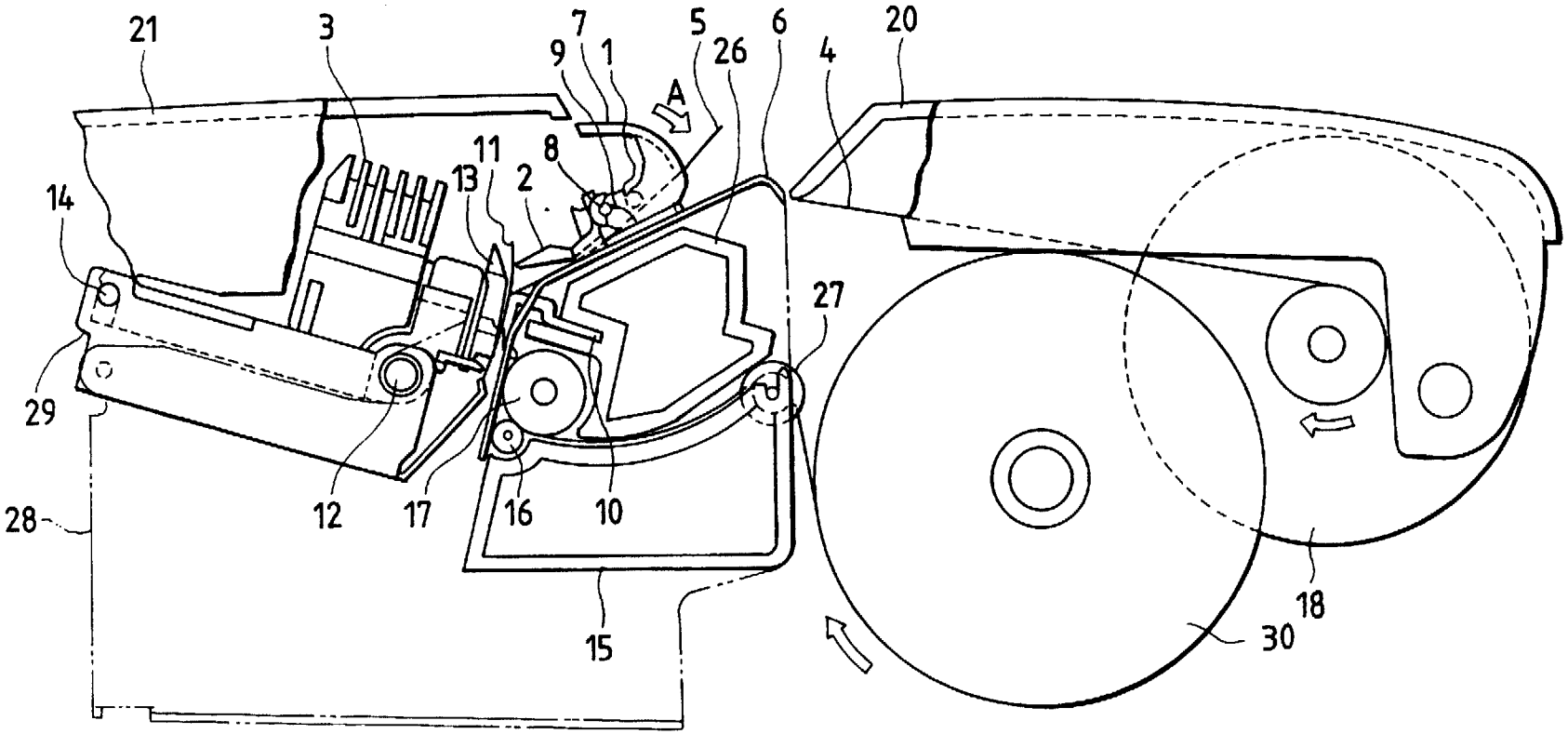
FIG. 1 is a schematic sectional view showing a first embodiment of the present invention.
Figure 2:
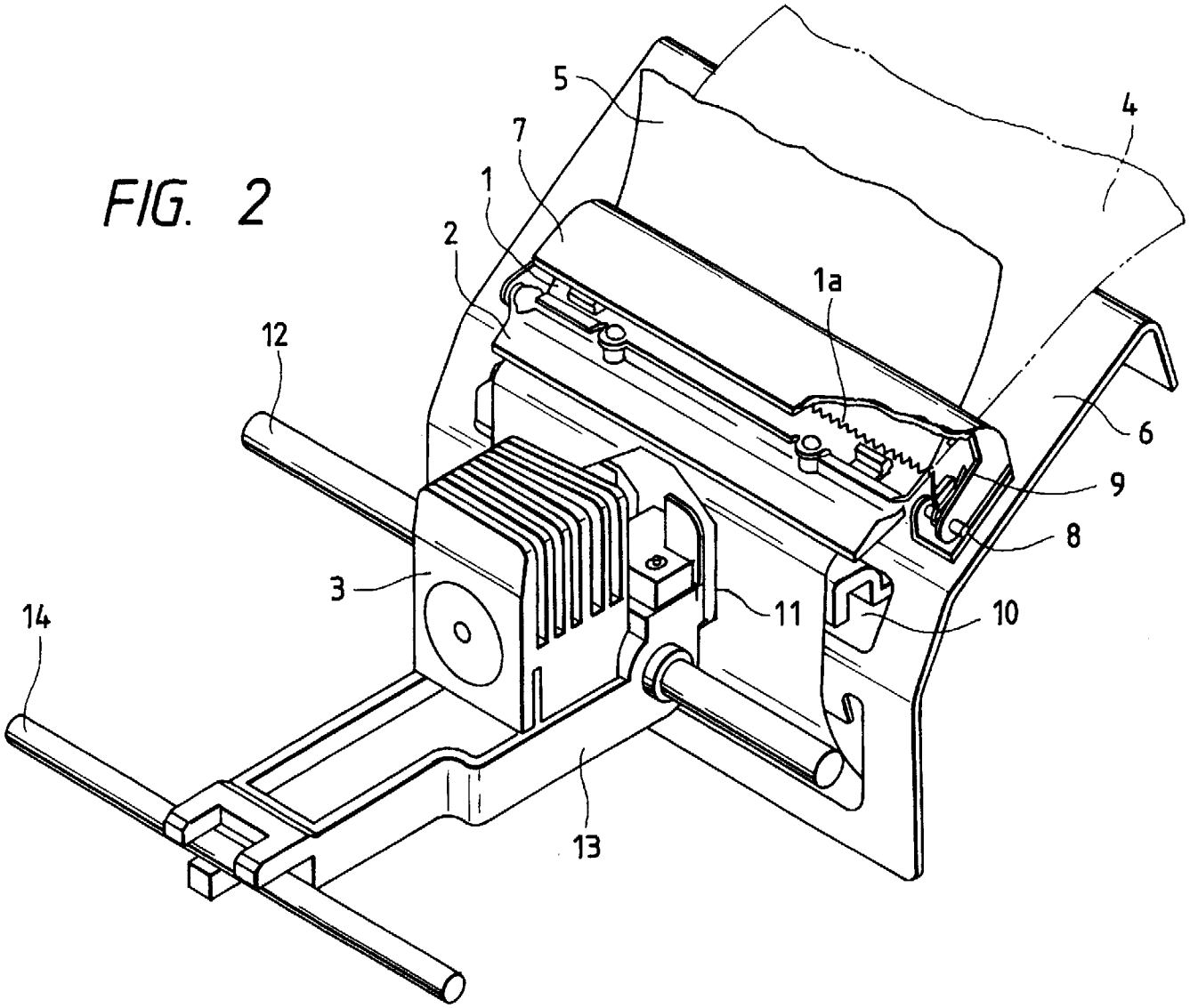
FIG. 2 is a perspective view showing cutter and printing mechanisms according to the first embodiment of the present invention.

FIG. 1 is a schematic sectional view illustrating a printer equipped with a cutter mechanism, and FIG. 2 a perspective view showing the construction of the cutter mechanism and a printing mechanism.

A carriage 13 equipped with a printhead 3 is slidably fitted to guide shafts 12, 14 in parallel to and supported by side walls each extending upright from both sides of a printing frame 29 formed of a thin metal sheet. A carriage driving motor, a driving pulley turned by the motor, a driven pulley, and a carriage driving belt suspended by the driving pulley and the driven pulley and mated with a carriage 13 are disposed in the printing frame 29. The whole mechanism for reciprocating the printhead is disposed in the printing frame 29 so as to constitute the printing mechanism. (The motor, the driving pulley, the driven pulley and the carriage driving belt are not shown).

A paper feed mechanism is mounted in a body frame 28 which is formed of a thin metal sheet. More specifically, upper and lower resin-molded paper guides 15, 26 are fitted to the body frame 28 so as to form a predetermined clearance for use as a paper passageway. A paper guide inlet roller 27 is rotatably placed at a recording-paper insertion opening on the side of the lower paper guide 15. Since the paper guide inlet roller 27 is rotated when it conveys the recording paper, the frictional load of the recording paper with the inlet of the lower paper guide 15 considerably decreases, thus lightening the load applied to the paper feed roller.

The platen 10 is forced into the upper paper guide 26, which is fitted to the body frame 28.

The feed roller 17 fitted to the body frame 28 and driven by a paper feed motor (not shown), and the pinch roller 16 pressed against the feed roller 17 are disposed in the passageway of the recording paper under the platen 10.

Reference numeral 6 denotes the writing table provided with an opening through which the recording paper passes, and an opening where the platen 10 is placed, the writing table being used to guide the back surface of the recording paper.

A transparent cutter fitting stand 2 formed of polycarbonate is fitted to the writing table 6 so that the recording paper is able to pass through the clearance between the writing table 6 and the cutter fitting stand 2. The cutter 1 provided with the blade is secured to the cutter fitting stand 2 with screws.

Projections each having holes are each provided at both the left and right ends of the cutter fitting stand 2, and the cutter cover 7 having a transparent polycarbonate end portion 7*a* for use in regulating the recording paper in the direction of the writing table 6 is rotatably fitted to a cutter cover shaft 8 stretching over the projections of the cutter fitting stand 2.

Further, a torsion spring as a cutter cover spring 9 keeps a moment acting on the cutter cover 7 in the direction of an arrow A, and the cutter cover 7, when in the standby position covers the blade 1*a* of the cutter 1.

Moreover, the clearance between the end portion 7*a* of the cutter cover 7 on standby and the writing table 6 is set greater than the clearance between the cutter fitting stand 2 and the writing table 6.

Figure 8:
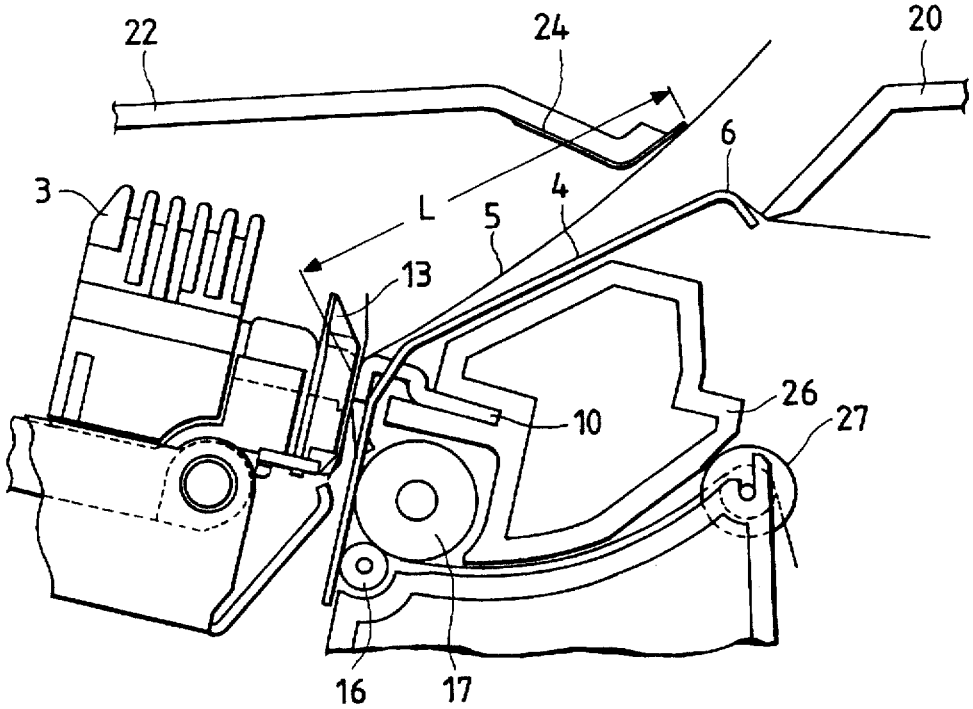
FIG. 8 PRIOR ART
FIG. 8 is a sectional view showing a second example of the prior art.
Figure 9:
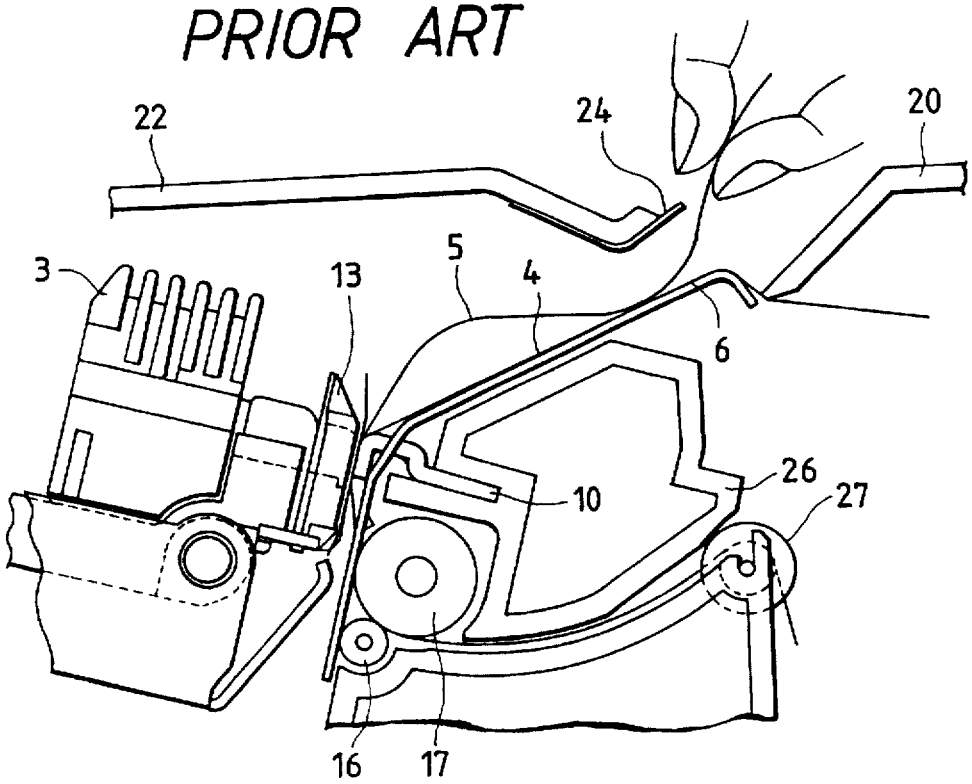
FIG. 9 PRIOR ART
FIG. 9 is a diagram illustrating a situation where the movement of recording paper is obstructed in the second example of the prior art.

Even when the cutter cover 7 remains in the standby position, the front end of the writing stand 6 is formed so that it has a planar portion where it is possible to make an entry from the end portion 7*a* of the cutter cover 7 in the direction in which the recording paper proceeds. In a case where the operator wants to make an additional entry into the printed journal paper 4 or the printed receipt paper 5 because an input has already been applied thereto by mistake, it is allowed for him to make a correction by turning the cutter cover 7 to make use of the writing table 6, depending on the quantity of correction such as a cancellation line. When the position of correction is close to the printing unit, moreover, an entry may be made into the receipt paper 5 or the journal paper 4 by turning the cutter cover 7 from above the writing table 6. Since the cutter cover 7 is automatically reset to the standby position after the writing operation is terminated, the large casing does not need to be opened or closed each time the writing operation is performed as in the case of the second example of the prior art shown in FIG. 8.

The casing accommodating this printer has a recording paper storage area in the rear of the printer, and the storage area contains rotatable rolled paper 30 and a winding mechanism including a winding shaft 18 for winding the journal paper as printed recording paper.

In this embodiment of the invention, the printing frame 29 equipped with the printing mechanism for making printing is secured to the body frame 28 having the paper feed mechanism for feeding paper with screws so as to allow the printhead 3 to move in parallel to the platen 10.

The operation of the printer will be described now.

In this embodiment of the invention, moreover, a description will be given of recording paper comprising receipt paper to be cut off as a receipt after a printing operation is terminated and pressure sensitive copying paper as journal paper to be kept as records at a store by way of example.

Double-layer recording paper having upper recording paper to which characters are transferred through an inked ribbon and lower pressure sensitive paper is rewound out of rolled paper 30. The recording paper is inserted via the paper guide inlet roller 27 into the clearance, known as the paper passageway, formed in between the lower paper guide 15 and the upper paper guide 26, and led to and held between the pressurizing portions of the paper feed roller 17 and the pinch roller 16. Paper feed is effected while the rotation-controlled paper feed roller 17 is rotated.

Then the recording paper is passed through the opening of the writing table 6 and guided by the mask plate fitted to the carriage into the clearance between the platen 10 and the printhead 3 before being conveyed upward via the clearance.

The recording paper conveyed upward is made to contact against a wide-mouthed guide located at the cutter fitting stand 2 and as the guide tilts in the direction in which the recording paper proceeds, the front end of the recording paper is guided to the cutter side and then to the lower side of the cutter 1 via the clearance formed between the cutter fitting stand 2 and the writing table 6. Since the cutter fitting stand 2, and the cutter cover are transparent, the condition of the front end of the paper transfered from the printing unit can be checked and the printing condition immediately after the printing operation is performed can also be checked. Moreover, the cutter cover 7 on standby completely covers the cutter 1, so that the operator is prevented from touching the blade of the cutter 1.

The upper receipt paper 5 used as a receipt is conveyed to the upper side of a casing cover 20, whereas the lower recording paper is used as the journal paper 4, whereby the latter is moved the underside of the casing cover 20 and wound on the winding shaft 18 which is driven to rotate in synchronization with the rotation of the paper feed roller 17.

Figure 3:
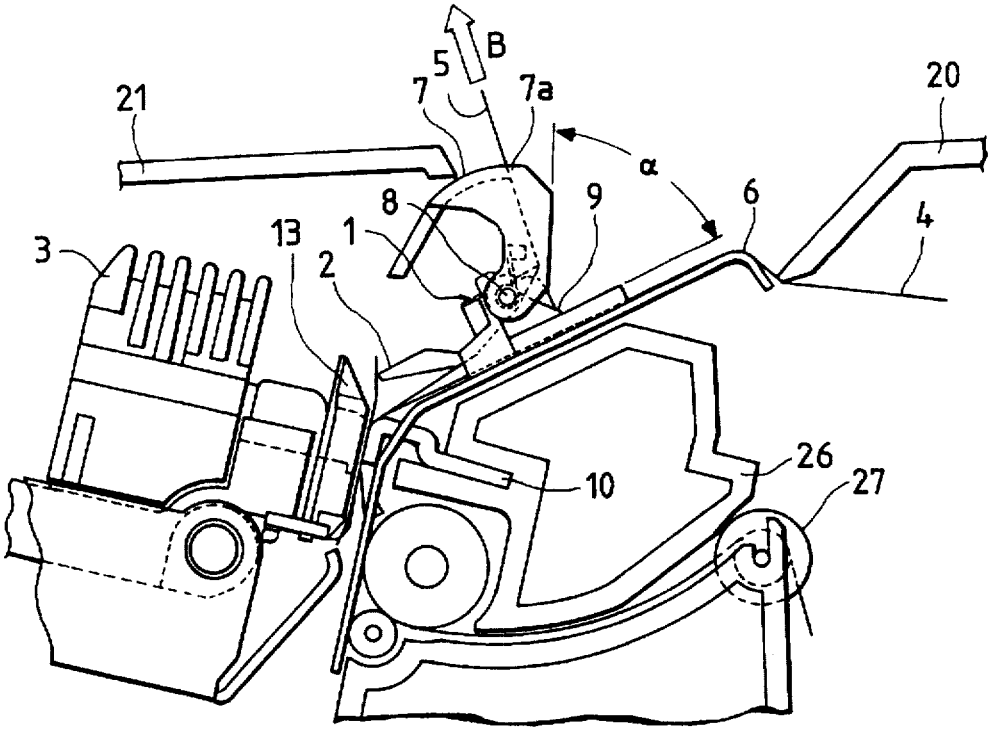
FIG. 3 is a diagram illustrating a situation where receipt paper is cut according to the first embodiment of the present invention.
Figure 4:
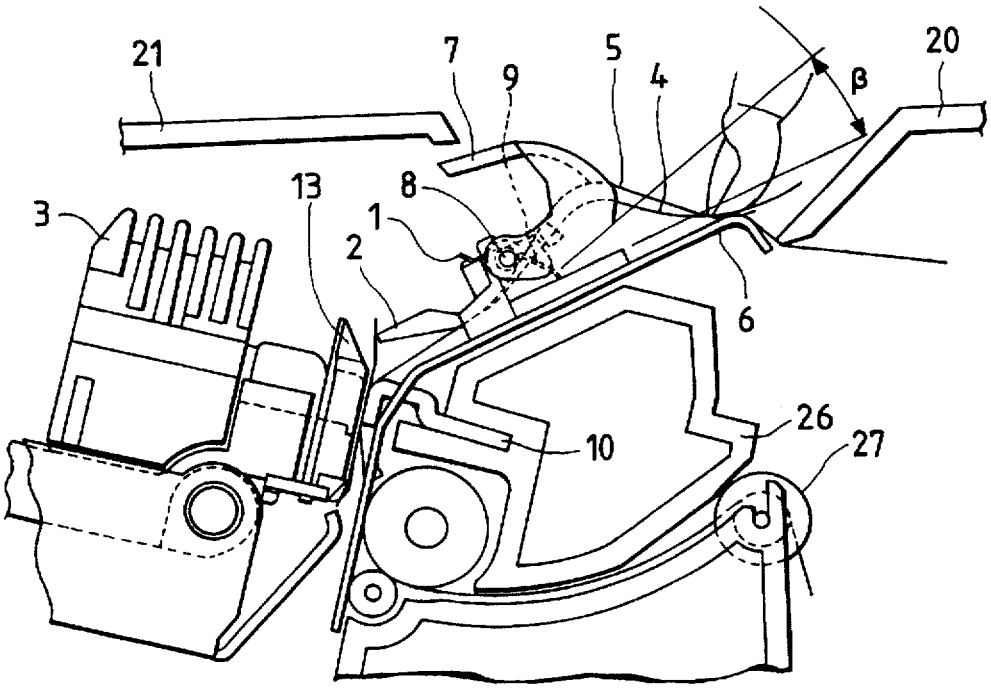
FIG. 4 is a diagram illustrating a situation where the movement of recording paper is obstructed according to the first embodiment of the invention.

Referring to FIGS. 3, 4, the operation of the cutter mechanism will be described now.

FIG. 3 illustrates a case where the operator cuts the receipt paper, and FIG. 4 illustrates a case where the operator interferes with the movement of the recording paper.

After the desired printing operation is completed by means of the printhead 3, the paper feed roller 17 is rotated so as to place the final line of the recording paper on the downstream side of the blade of the cutter 1 and stopped after a predetermined quantity of paper is fed. When the operator lifts up the front end of the receipt paper 5 in the direction of a thumbing arrow B that is, at substantiall right angles in view of the direction in which the recording paper is conveyed, the receipt paper 5 forces the end portion 7*a* of the cutter cover 7 upward, whereby the rotatable cutter cover 7 pivots against the moment of the cutter cover spring 9. When the cutter cover 7 turns by a predetermined angle of α, the receipt paper 5 and the blade of the cutter 1 contact against each other and when the receipt paper 5 is pulled up in the direction of the arrow B further, the receipt paper 5 is cut by the cutter 1. The cutter cover 7 is reset by the cutter cover spring 9 to the standby position after the receipt paper 5 is cut off.

The moment of the cutter cover spring 9 is, as noted previously, limited in strength to force up the cutter cover 7 resulting from the phenomenon of the relaxed recording paper without breaking the receipt paper when the receipt paper 5 is cut off, and keeping the cutter cover 7 standby.

A description will be given of a case where the operator interferes with the movement of the recording paper by grabbing the moving receipt paper or holding it down onto the writing stand 6.

Even when the movement of the recording paper is obstructed, the recording paper remains less stiff since the position of the recording paper where the cutter cover 7 interferes with the movement of the recording paper is set apart from the printing position. As a result the recording paper becomes loosened up the writing table 6 in on the rear of the cutter 1 as shown in FIG. 4, since the clearance between the writing table 6 and the end portion 7*a* of the cutter cover 7 is wider than the clearance between the writing table 6 and the cutter fitting stand 2. When the loosened quantity increases, the receipt paper 5 forces the end portion 7*a* upward so as to swivel the cutter cover 7. As the cutter cover 7 thus pivots, there is formed a large space up the writing table, whereby the loosened recording paper is absorbed into the space.

As a result, the paper feed roller 17 feeds paper at a predetermined pitch without affecting the recording paper which is being printed in the vicinity of the printhead 3 and the platen 10. Consequently, there develops no deterioration of printing quality arising from nonconforming paper feeding and overlapped printing.

As the recording paper is prevented from floating from the platen 10, further, it will never be caught by the carriage 13 and the printhead 3 which are moving in the direction perpendicular to the direction in which it is conveyed. Therefore, the mask plate is not caused to malfunction and paper jamming which breaks the recording paper does not occur, which is often the case with the prior art. As paper jamming is nonexistent, the folded recording paper is unfolded when the receipt paper 5 is pulled out and usable as an ordinary receipt.

2nd Embodiment

Figure 5:
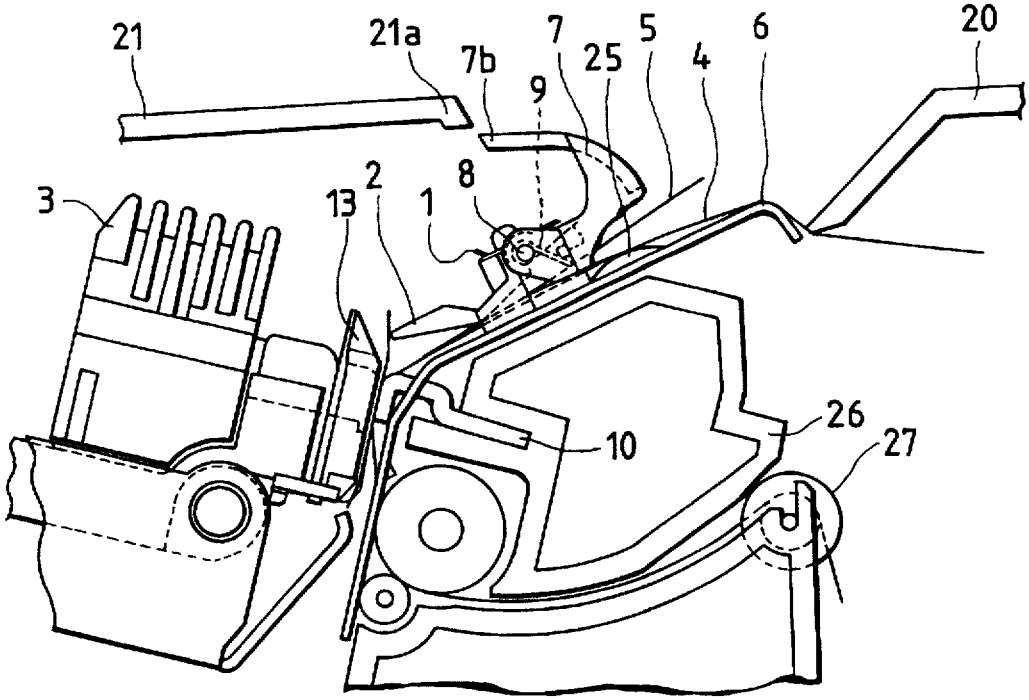
FIG. 5 is a diagram illustrating the protrusion of a writing table according to a second embodiment of the present invention.
Figure 6:
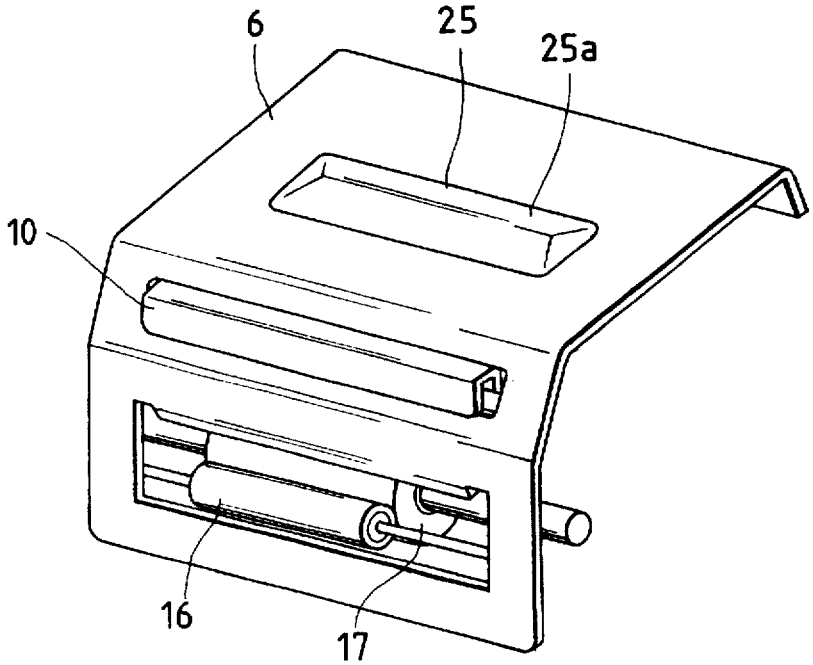
FIG. 6 is a perspective view illustrating the writing table according to the second embodiment of the present invention.
Figure 7:
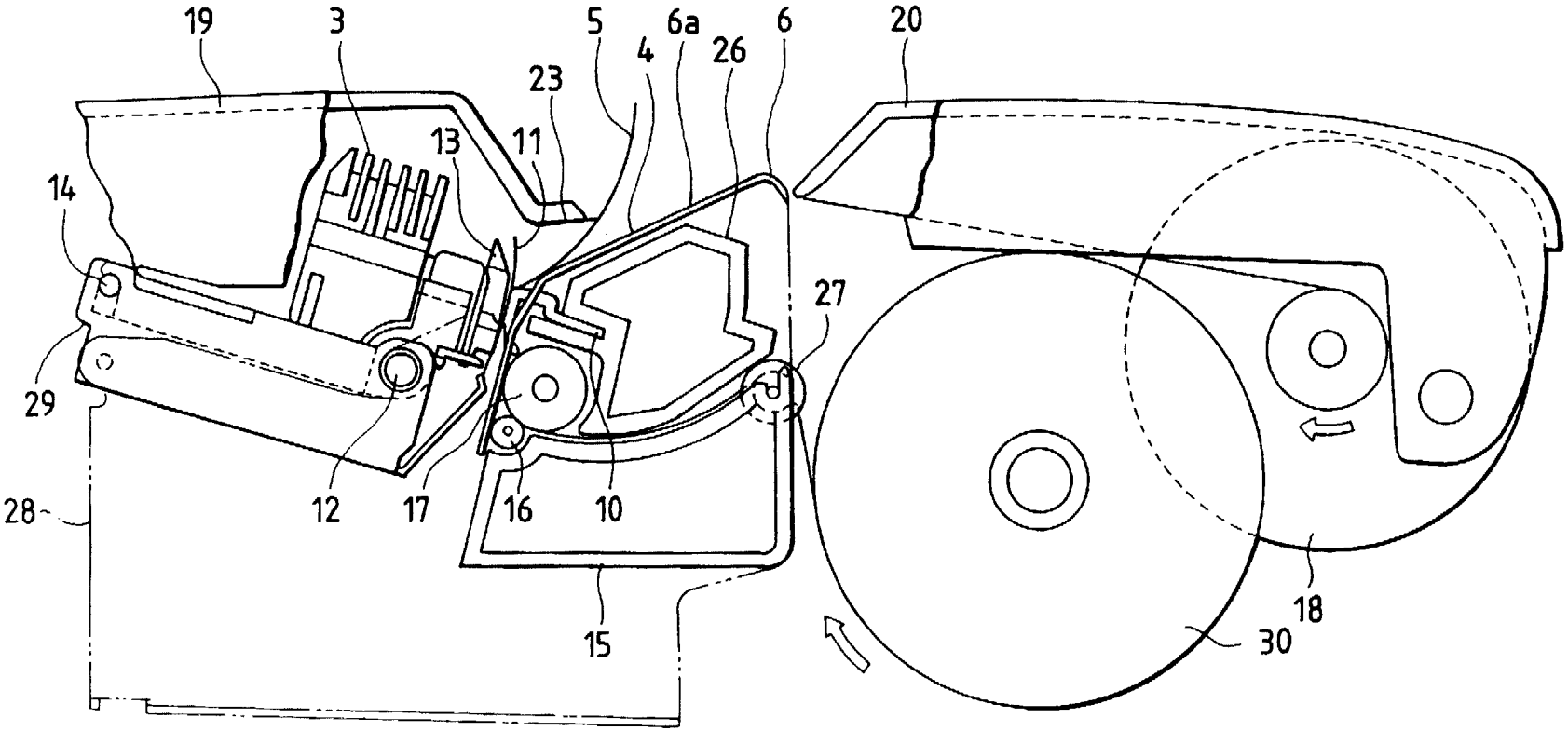
FIG. 7 PRIOR ART
FIG. 7 is a sectional view showing a first example of the prior art.

Referring to FIGS. 5 and 6, the second embodiment of the present invention will be described.

FIG. 5 is a schematic sectional view of the second embodiment of the invention, and FIG. 6 is a perspective view of a writing table. The second embodiment includes a writing table which is a modified version of what is shown in the first embodiment of the invention, wherein like reference characters designate like component parts of the first embodiment of the invention.

A turned-up protrusion 25 is formed by drawing on a part of the writing table 6. The protrusion 25 of the writing table is positioned under the cutter cover 7.

A description will be given of the case where the operator happens to interfere with the movement of the recording paper by grabbing the receipt paper 5 or hold it down onto the writing table 6 in that state. The journal paper 4 sliding on the surface of the writing table 6 is normally caused to slightly curve by the protrusion 25 of the writing table while it is conveyed. When the operator interferes with the movement of the recording paper, the receipt paper 5 is curved by a sloping surface 25*a* as the rising portion of the protrusion 25 of the writing table and curved on the downstream side of the blade of the cutter 1. The recording paper is thus curved by the protrusion 25 of the writing table 6 beforehand so as to make it become readily curved to ensure that it curves and loosens at the position of the protrusion 25 of the writing table, whereby the cutter cover 7 pivots. Since the recording paper can thus be loosened at the desired position in the second embodiment of the invention, the reliability is improved further accordingly.

Although a detailed description has been given of the case where the protrusion 25 of the writing table is made triangular in cross section according to this embodiment of the invention, it may be convex without such a sloping surface. Further, the protrusion 25 may be positioned between the blade of the cutter 1 and the end portion 7*a* of the cutter cover 7 on standby or otherwise the rising portion on the downstream side of the protrusion may be positioned therebetween to achieve an effect similar to what is attainable according to this embodiment of the invention because the receipt paper 5 can be curved on the downstream side of the cutter 1.

With reference to the height of the protrusion of writing table 25, the height from the writing table 6 is determined in such a manner that the height is larger than the clearance between the printing unit and the protrusion of writing table 25, the clearance forms a part of the paper passageway. Since the recording paper can thus be loosened on the downstream side of the above clearance, the reliability is improved further accordingly.

In reference to the positional relation between the cutter cover 7 and the casing 21, if the clearance between the front edge 21*a* of the opening of an upper casing 21 and the tail 7*b* of the cutter cover 7 during the time the cutter cover remains on standby, and the clearance between the upper casing and the side of the cutter cover 7 are set narrow as much as possible, the outlet for the receipt paper 5 in the rear of the cutter cover will be covered with the cutter cover, whereby noise emanating from the vicinity of the printhead 3 and the platen 10 is prevented from being directly transmitted to the operator. Since the noise is thus attenuated by the cutter cover, any noise radiating therefrom decreases, which makes it possible to provide a quieter printer.

Although the cutter cover spring has been employed to keep up the standby position of the cutter cover according to this embodiment of the invention, the spring may be formed integrally on the cutter side. Further, the fulcrum of the rotatable cutter cover may be placed on the upstream side of the recording paper to be conveyed so as to make always narrower the space between the end portion 7*a* of the cutter cover 7 and the writing table by means of gravity. In this case, a decrease in the number of urging members results in reducing not only parts cost but also assembly cost, thus contributing to product-manufacturing cost reduction.

What is claimed is:

1. A printer having a cutter for cutting continuous recording paper to length, the printer comprising:

a printing unit for printing;

a recording paper guide member for forming a recording paper passageway by regulating the back surface of the recording paper, wherein the recording guide member is placed on the downstream side of the printing unit;

a cutter which is placed opposite to the recording paper guide member so as to leave a clearance through which the recording paper is passed, the cutter including a blade for cutting the recording paper in a direction perpendicular to the direction in which the recording paper is conveyed;

a cutter cover pivotally rotatable in a plane substantially perpendicular to said recording paper, the cutter cover including a regulating end portion for regulating a distance between the recording paper on the downstream side of the cutter and the recording paper guide member; and means for urging the cutter cover towards the recording paper guide member and regulating a space between the regulating end portion and the recording paper guide member according to the position of the recording paper.

2. A printer as claimed in claim 1, wherein said means for urging the cutter cover is an operation by gravity of the cutter cover.

3. A printer as claimed in claim 2, wherein the recording paper guide member is provided with a protrusion for moving the recording paper closer to the cutter, wherein the protrution is diposed between the cutter and the regulating end portion of the cutter cover on standby.

4. A printer as claimed in claim 3, wherein an upright part is formed on the downstream side of the protrution.

5. A printer as claimed in claim 1, wherein said means for urging the cutter cover is a spring.

6. A printer as claimed in claim 5, wherein the recording paper guide member is provided with a protrusion for moving the recording paper closer to the cutter, wherein the protrution is diposed between the cutter and the regulating end portion of the cutter cover on standby.

7. A printer as claimed in claim 6, wherein an upright part is formed on the downstream side of the protrution.

8. The printer according to claim 7, wherein the cutter cover is made of transparent material.

9. The printer according to claim 6, wherein the cutter cover is made of transparent material.

10. A printer as claimed in claim 1, wherein the recording paper guide member is provided with a protrusion for moving the recording paper closer to the cutter, wherein the protrution is disposed between the cutter and the regulating end portion of the cutter cover on standby.

11. A printer as claimed in claim 10, wherein an upright part is formed on the downstream side of the protrution.

12. A printer as claimed in claim 1, further comprising a cutter fitting stand for mounting the cutter to the writing table, wherein said space between the writing table and the regulating end portion is greater than a clearance between the writing table and the cutter fitting stand.

13. A printer comprising:

a printing unit for printing on a recording medium;

a recording medium guide member for forming a recording medium passageway, the recording medium guide member being placed on the downstream side of the printing unit;

a cutter including a blade for cutting the recording medium, the cutter being placed on the downstream side of the printing unit; and a cutter cover moving between a standby position at which said cover substantially covers said cutter and a cutting position at which said cutter is partially exposed to cut said recording medium, wherein said cutter cover is moved from said standby position to said cutting position by said recording medium during a cutting operation.

14. The printer according to claim 13, wherein the cutter cover is disposed opposite to the recording medium guide member and the recording medium guide member protrudes toward the cutter cover in at least one portion between the downstream-side end of the cutter cover and the blade.

15. The printer according to claim 14, wherein the cutter cover is made of transparent material.

16. The printer according to claim 13, wherein the cutter cover is made of transparent material.

17. The printer according to claim 13, further comprising means for urging said cutter cover toward said standby position.

18. The printer according to claim 17, wherein said urging means is a spring.

19. The printer according to claim 13, wherein said recording medium contacts said cutter cover to move said cutter cover to said cutting position.

* * * * *